US012703021B2

(12) United States Patent
Luecke et al.

(10) Patent No.: US 12,703,021 B2
(45) Date of Patent: Aug. 11, 2026

(54) METHOD FOR PRODUCTION OF A STEEL TUBULAR PRODUCT, IN PARTICULAR AN AIRBAG TUBULAR PRODUCT, AND A STEEL TUBULAR PRODUCT PRODUCED USING THIS METHOD, IN PARTICULAR AN AIRBAG TUBULAR PRODUCT

(71) Applicant: BENTELER STEEL/TUBE GMBH, Paderborn (DE)

(72) Inventors: Daniel Luecke, Brakel (DE); Dirk Tegethoff, Salzkotten (DE); Marcel Wellpott, Paderborn (DE)

(73) Assignee: BENTELER STEEL/TUBE GMBH & CO. KG, Paderborn (DE)

( * ) Notice: Subject to any disclaimer, the term of this patent is extended or adjusted under 35 U.S.C. 154(b) by 600 days.

(21) Appl. No.: 17/892,164

(22) Filed: Aug. 22, 2022

(65) Prior Publication Data

US 2023/0061970 A1 Mar. 2, 2023

(30) Foreign Application Priority Data

Aug. 27, 2021 (EP) ..... 21193602

(51) Int. Cl.
*B21D 19/16* (2006.01)
*B21D 41/04* (2006.01)
(Continued)

(52) U.S. Cl.
CPC ..... *B21D 19/16* (2013.01); *B21D 41/04* (2013.01); *B21K 21/12* (2013.01); *B21D 53/88* (2013.01); *B21K 21/14* (2013.01)

(58) Field of Classification Search
CPC ..... B21D 19/16; B21D 41/04; B21D 41/045; B21D 53/88; B21K 21/12; B21K 21/14
See application file for complete search history.

(56) References Cited

U.S. PATENT DOCUMENTS 2,357,100 A 8/1944 Gebauer-Fuelnegg et al.
3,754,429 A * 8/1973 Creuzet ..... B21D 41/04 72/370.13
(Continued)

FOREIGN PATENT DOCUMENTS

CH 322716 A 6/1957
CN 103817490 A 5/2014
(Continued)

*Primary Examiner* — Christopher L Templeton
*Assistant Examiner* — Matthew Stephens
(74) *Attorney, Agent, or Firm* — Norman B. Thot

(57) ABSTRACT

The present invention provides a method for producing a steel tubular product which includes shaping a steel tube into a pre-geometry by non-rotationally and axially moving the steel tube into an outer tool to reduce an outer diameter of the pre-geometry in an end region in the outer tool. An inner diameter is calibrated with the pre-geometry arranged within the outer tool by introducing an inner mandrel into the end region of the pre-geometry, and pressing against the outer tool to calibrate the inner diameter via a shaping. The pre-geometry is non-rotationally removed from the outer tool, and the inner mandrel is non-rotationally removed from the pre-geometry. The pre-geometry is moved axially into a drawing tool, thereby shaping the pre-geometry into the steel tubular product with a rotationally symmetrical outlet opening centrally in the end face. The steel tubular product is then removed from the drawing tool.

15 Claims, 2 Drawing Sheets

(51) Int. Cl.

| | |
|---|---|
| ***B21D 53/88*** | (2006.01) |
| ***B21K 21/12*** | (2006.01) |
| ***B21K 21/14*** | (2006.01) |

(56) References Cited

U.S. PATENT DOCUMENTS

| | | | | |
|---|---|---|---|---|
| 6,758,921 | B1 * | 7/2004 | Streubel | B21D 53/88 148/519 |
| 2006/0112751 | A1 * | 6/2006 | Hakansson | B21K 21/14 72/267 |
| 2010/0102808 | A1 | 4/2010 | Boenisch | |
| 2015/0209840 | A1 * | 7/2015 | Koyer | B21D 22/208 72/40 |
| 2016/0231282 | A1 | 8/2016 | Koenig | |
| 2017/0101693 | A1 * | 4/2017 | Lömker | C21D 9/14 |

FOREIGN PATENT DOCUMENTS

| | | | | |
|---|---|---|---|---|
| DE | 196 07 010 | C1 | 12/1996 | |
| DE | 197 14 753 | B4 | 1/2012 | |
| EP | 1704944 | A1 * | 9/2006 | B21D 41/04 |
| GB | 769345 | A * | 2/1957 | B21K 21/12 |
| JP | S 49-88767 | A | 8/1974 | |
| JP | S 61-127842 | U | 8/1986 | |
| JP | H 1-249231 | A | 10/1989 | |
| JP | H08201347 | A | 8/1996 | |
| JP | 2001-170723 | A | 6/2001 | |
| JP | 2006-159224 | A | 6/2006 | |
| JP | 2008032575 | A | 2/2008 | |
| JP | 2016-106034 | A | 6/2016 | |
| WO | WO 2008/111123 | A1 | 9/2008 | |
| WO | WO 2021/034037 | A2 | 2/2021 | |

* cited by examiner

METHOD FOR PRODUCTION OF A STEEL TUBULAR PRODUCT, IN PARTICULAR AN AIRBAG TUBULAR PRODUCT, AND A STEEL TUBULAR PRODUCT PRODUCED USING THIS METHOD, IN PARTICULAR AN AIRBAG TUBULAR PRODUCT

CROSS REFERENCE TO PRIOR APPLICATIONS

Priority is claimed to European Patent Application No. 21193602.6, filed Aug. 27, 2021. The entire disclosure of said application is incorporated by reference herein.

FIELD

The present invention relates to a method for production of a steel tubular product, in particular an airbag tubular product, and a steel tubular product produced using this method, in particular an airbag tubular product.

BACKGROUND

High-strength or ultra-high strength steel tubular products are used in many technical industrial applications. Such tubular products are in particular also used as airbag tubes.

DE 197 14 753 B4 describes a method for production of such a tubular product. A tubular metal workpiece is introduced into a mold, the diameter of which is substantially greater than that of the workpiece, wherein the mold of the workpiece is driven in rotation by separate drives in the same rotational direction around mutually parallel aligned longitudinal axes, and a shaping pressure is generated by an advance movement of the mold and workpiece. During this shaping, the workpiece rolls on the periphery of the mold, and the end of the workpiece in the mold is melted by frictional heat and formed into a container base. A mandrel is introduced into the workpiece and, during shaping, exerts an internal pressure on the container being formed, and rotates with the workpiece.

Such flow rolling is based on the process principle of pressing or pressure rolling. The essential difference from this is that the tool is not a roller which starts from a specific shape, but a pot-like tool in which the entire mold course is worked. The components which can be produced using this method must however be rotationally symmetrical.

DE 196 07 010 C1 also describes such a method.

Although satisfactory results for tubular products, in particular airbag tubular products, can be obtained using this method, such production processes have considerable disadvantages. Because of the rotation of the tubular product and also of the tool during the production of the tubular product, complex equipment is required for producing such tubular products. Production is also very time-consuming and the tube surface may be adversely affected.

SUMMARY

An aspect of the present invention is to provide a simpler production method for such tubular products, in particular airbag tubular products, in order to significantly reduce the complexity of manufacturing and equipment.

In an embodiment, the present invention provides a method for production of a steel tubular product which includes a step a) of providing a steel tube. The steel tube is shaped into a pre-geometry in a step b). The shaping is performed by axially moving the steel tube into an outer tool so as to thereby provide the pre-geometry with an outer diameter which is reduced in an end region in the outer tool. An inner diameter of the pre-geometry is calibrated in a step c). The calibrating is performed while the pre-geometry is arranged within the outer tool by introducing an inner mandrel having an outer diameter which corresponds to the inner diameter of the pre-geometry into the end region of the pre-geometry, and pressing the pre-geometry against the outer tool so that the inner diameter of the pre-geometry is calibrated via a shaping in the end region. The pre-geometry is removed from the outer tool and the inner mandrel is removed from the pre-geometry in a step d). In a step e), the pre-geometry is axially moved into a drawing tool comprising a roll-in contour which comprises a concave shape, thereby simultaneously shaping the pre-geometry into the steel tubular product comprising a rotationally symmetrical outlet opening which is positioned centrally in the end face. The steel tubular product is removed from the drawing tool in a step f). No rotation of the pre-geometry with respect to the outer tool is performed in either the step b) or the step d).

BRIEF DESCRIPTION OF THE DRAWINGS

The present invention is described in greater detail below on the basis of embodiments and of the drawings in which.

DETAILED DESCRIPTION

Figure 1:
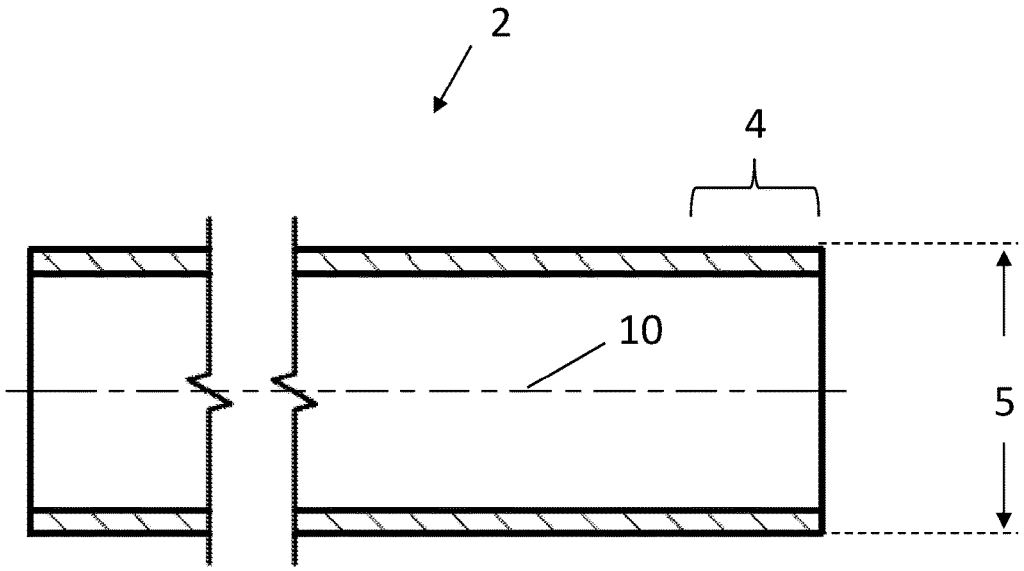
FIG. 1 shows an exemplary embodiment of a steel tube to be provided for production of a tubular product with the method according to the present invention.

The method according to the present invention for production of a steel tubular product, in particular an airbag tubular product, comprises the following steps:

a) providing a steel tube;
b) shaping of the steel tube into a pre-geometry, wherein in an end region, an outer diameter of the steel tube is reduced by axial movement into an outer tool;
c) calibration of an inner diameter of the pre-geometry, wherein the pre-geometry is still laid in the outer tool, and an inner mandrel, with an outer diameter corresponding to the inner diameter of the calibrated pre-geometry, is introduced into the end region of the pre-geometry, and the pre-geometry is pressed against the outer tool, so that the inner diameter of the pre-geometry is calibrated by shaping;
d) removing the pre-geometry from the outer tool and removing the inner mandrel from the pre-geometry;
e) axially moving the pre-geometry into a drawing tool with a roll-in contour having a pot-like concavity, with a simultaneous shaping of the pre-geometry into the tubular product with a rotationally symmetrical outlet opening positioned centrally in the end face; and
f) removing the tubular product from the drawing tool.

With the method according to the present invention, the complexity of manufacturing and equipment for production of a tubular product according to the present invention, or an airbag tubular product, is significantly reduced since, in comparison with production of such tubular products via flow rolling, rotation of both the workpiece and also of the tool can be completely omitted. The fact that only axial movements of the tubular product and/or the tools used are required does not only significantly reduce the complexity of manufacturing and equipment. The process of shaping the provided steel tube can thereby take place more quickly and economically. By avoiding the rotation of the steel tube and/or tool, very high friction temperatures can also be avoided so that by reducing the shaping temperatures, the formation of scale can be significantly reduced. With the multistage shaping and calibration process according to the present invention, the complexity of material removal operations during production of the tubular product can also be minimized, wherein material removal for the outlet opening even becomes obsolete.

Calibration of the inner diameter of the pre-geometry as described in step c) means that, in comparison with flow rolling known from the prior art, a reduction in shaping temperature is achieved which contributes to a substantial reduction in scale formation. This shaping can, for example, takes place as cold forming or cold drawing.

In a first advantageous embodiment of the method according to the present invention, it is provided that the shaping in step b) takes place as cold forming or cold drawing. In comparison with flow rolling known from the prior art, this feature also achieves a reduction in shaping temperature, which contributes to a considerable reduction in scale formation.

In cold drawing or cold forming, shaping takes place at a room temperature of around 293 K and a temperature of less than 473 K, in particular without preheating and without heated tools. The omission of preheating of the workpiece or tools achieves a significantly improved energy balance since the workpieces and/or the tools must be preheated for flow rolling.

The drawing and calibration in step b), and the above-described following calibration before step c), are carried out over a partial length of the tube or tube end. In one embodiment of the present invention, this partial length may be completely finish-formed by the rolling in so that no portion of reduced diameter remains on the finished tubular product.

It is, however, also possible that, in a targeted fashion, a greater partial length is drawn in and calibrated than is used or consumed in the subsequent rolling in, so that a partial length with a reduced diameter, calibrated to maximum size, remains between the rolled tube end and the unshaped tube portions. This partial length can, for example, be used as a fixing region for inserts and/or attachments on the tubular product.

The present invention also provides that the shaping in step e) takes place as hot forming or as semi-hot forming. With a steel alloy, this means preheating the workpiece, i.e., here the pre-geometry, to a temperature range of between 673 K and the Ac3 temperature (around 1173 K for steel alloys)+50 K, whereby an easier shaping of the pre-geometry is achieved. In the case of hot forming, preheating takes place to at least the Ac3 temperature for the purpose of austenitizing the steel alloy, and, after step e), or immediately after the optional finish-forming described in the following paragraph, quenching is carried out for the purpose of hardening.

According to a particularly advantageous embodiment, the method according to the present invention provides that a calibration or a finish-forming of the end region and outlet opening of the tubular product takes place by insertion of a second inner mandrel, which has an outer contour corresponding to the inner contour of the end region to be produced of the tubular product, and an axial movement of the second inner mandrel and tubular product into a second outer tool, the inner contour of which corresponds to the outer contour of the end region to be produced of the tubular product. This embodiment of the present invention achieves, in a simple fashion, that the end region of the tubular product is easily shaped by axial movement of tools or inner mandrels and/or the pre-geometry, without rotation of the pre-geometry or one of the tools and/or inner mandrel. The complexity of manufacturing and equipment is here also significantly minimized with the method according to the present invention.

It has proved particularly advantageous that for calibration or finish-forming of the outlet opening, a second inner mandrel is used with a rotationally symmetrical element positioned centrally in the end face, the outer contour of which element corresponds to the inner contour of the outlet opening of the tubular product to be produced. It is thereby provided in a simple fashion that not only the entire end region of the tubular product can be produced with a substantially reduced complexity of manufacturing and equipment, without a rotation of the tubular product or pre-geometry or one of the tools including inner mandrels.

In order to optimize the energy balance of the production method, the present invention provides that the calibration or finish-forming of the end region and/or the outlet opening takes place in a residual heat of a hot forming or semi-hot forming carried out in step e), in particular at a temperature of at least 473 K of the used steel or the used steel alloy. After step e), calibration or finish-forming of the end region and outlet opening can, for example, be carried out immediately. The shapeability during finish-forming of the tubular product to be produced is improved, the higher the residual heat during calibration or finish-forming of the end region and/or outlet opening. An immediate finish-forming using residual heat also allows hardening if heated before step e) to >Ac3 temperature and the tubular product is rapidly cooled or quenched immediately after finish-forming.

In order to carry out the shaping of the steel tube or pre-geometry with minimal friction, the present invention provides that for shaping, lubricants are introduced between the steel tube or pre-geometry and the tools or inner mandrels. A temperature-resistant lubricant can, for example, be provided at least for hot forming or semi-hot forming.

The present invention provides that as steel for the steel tube, a steel alloy and in particular a hardenable UHS steel is used. Such steels offer the necessary stability so that tubular products produced in the method according to the present invention can also withstand high pressures, such as may occur, for example, in their interior when such tubular products are used as airbag tubular products.

The method according to the present invention is therefore distinguished in that, as a material of the tube or tubular product to be produced, a steel is used which, as well as iron and unavoidable melt-induced contaminants, comprises the following alloy elements as percentages by weight (wt-%):

C 0.07 to 0.50, for example, 0.07 to 0.20;
Si 0.05 to 0.55;
Mn 0.2 to 2.5, for example, 0.4 to 0.8;
P less than 0.025;
S less than 0.02;
Cr less than 2, for example, 0.8 to 1.0;
Ti less than 0.03, for example, less than 0.015;
Mo less than 0.6, for example, 0.25 to 0.4;
Ni less than 0.6, for example, 0.2 to 0.3;
Al 0.001 to 0.05, for example, 0.02 to 0.04;
V less than 0.5, for example, less than 0.1; and
Nb less than 0.1, for example, less than 0.06.

Using annealing steels of these compositions and the method according to the present invention, tubular products can be provided with notched bar impact work values of at least 70 J/cm$^2$ at 293 K and at least 50 J/cm$^2$ at 223 K. Such steels are in particular suitable for the production of airbag tubes with a tensile strength of at least 700 MPa, in particular at least 900 MPa.

The present invention also provides a tubular product, in particular an airbag tubular product, which was produced using the method according to the present invention.

Such an airbag tube has a tube wall with an outer face and an inner face, wherein the diameter of the tube wall is reduced at one tube end. At least a partial length with a reduced diameter is rolled and formed partially closed, wherein a rotationally symmetrical outlet opening delimits the tube wall at the rolled end face of the tube. The partial length with the reduced diameter has a carbon distribution, measured in the wall thickness direction, in a tolerance band of no more than 10%, and/or the partial length with reduced diameter is free from over-rolling, flaking, loose particles or chips.

An improved product surface is thereby achieved with reduced scale formation because of the lower shaping temperature, short process times, and the exclusion of air oxygen by constant contact between the tool and the heated surface in the shaping zone.

No flakes or loose particles additionally occur on the product surface since no over-rolling takes place. To this extent, on later use of the product, for example, on triggering of the airbag gas generator, no such particles can become detached and enter the airbag. Such particles in the tool may also cause persistent pitting on subsequently shaped parts.

Because of the lower shaping temperature, short process times and the exclusion of air oxygen by constant contact between the tool and heated surface in the shaping zone, a product surface is achieved with minimum partial or complete decarburization (soft skin). This partially and/or completely decarburized surface constitutes a weakness for mechanical damage in conventionally produced tubular products, in particular airbag tubular products.

Tubular products or airbag tubular products also show less strength loss of the material in the shaping zone because of the lower shaping temperature and short process time.

No chips occur on the tubular product since the material removal process is also obsolete. The presence of chips in the interior of the generator housing can therefore be safely excluded. In conventional production of airbag tubular products, such chips can be propelled into the airbag when the system is triggered, and hence cause personal injury.

Further aspects, advantages, features and possible applications of the present invention arise from the following description of exemplary embodiments with reference to the drawings. All features described and/or shown in the drawings, alone or in any sensible combination, form the subject of the present invention, even independently of their summary in the claims or back reference.

FIG. 1 shows a steel tube 2 which serves as a starting product for production of a tubular product according to the present invention using a method according to the present invention. The steel tube 2 is here configured as a rotationally symmetrical element with a constant outer diameter 5, which has a rotational axis 10 configured as a longitudinal axis.

Figure 2:
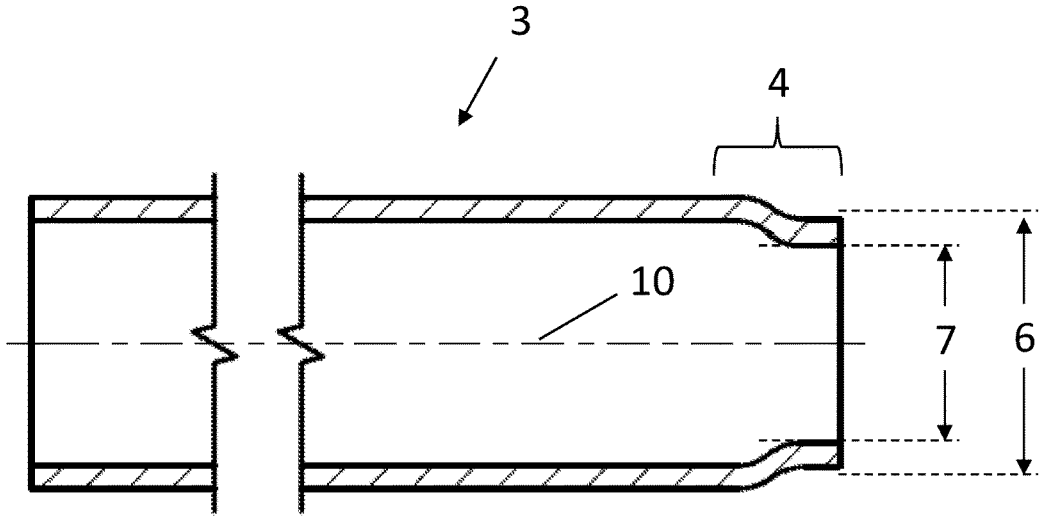
FIG. 2 shows the steel tube from FIG. 1 after an inventive method step for production of an uncalibrated pre-geometry.

After provision of the steel tube 2, this is shaped into a pre-geometry 3, wherein in an end region 4, an outer diameter of the steel tube 2 is reduced by axial movement into an outer tool (not shown here). Such a reduced outer diameter 6 is shown in FIG. 2, in which the end region 4 has already been accordingly shaped but not yet calibrated. This calibration takes place when the pre-geometry 3 is laid in an outer tool (not shown here), in which an inner mandrel (also not shown here), with an outer diameter corresponding to the inner diameter 7 of the calibrated pre-geometry 3, is introduced into the end region of the pre-geometry 3. The inner diameter 7 of the pre-geometry 3 is thus calibrated by this shaping.

By the reduction of the outer diameter 5 of the steel tube 2 to the outer diameter 6 of the pre-geometry 3, the wall thickness in the end region 4 of the pre-geometry 3 naturally increases in comparison with the wall thickness in the end region 4 of the steel tube 2.

Figure 3:
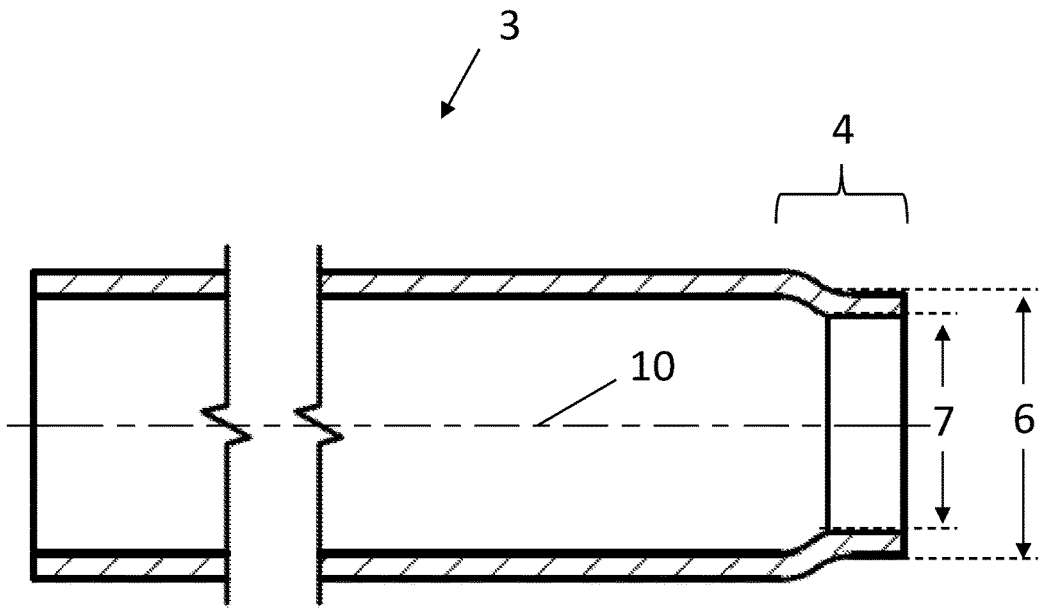
FIG. 3 shows the pre-geometry from FIG. 2 after a calibration.
Figure 4:
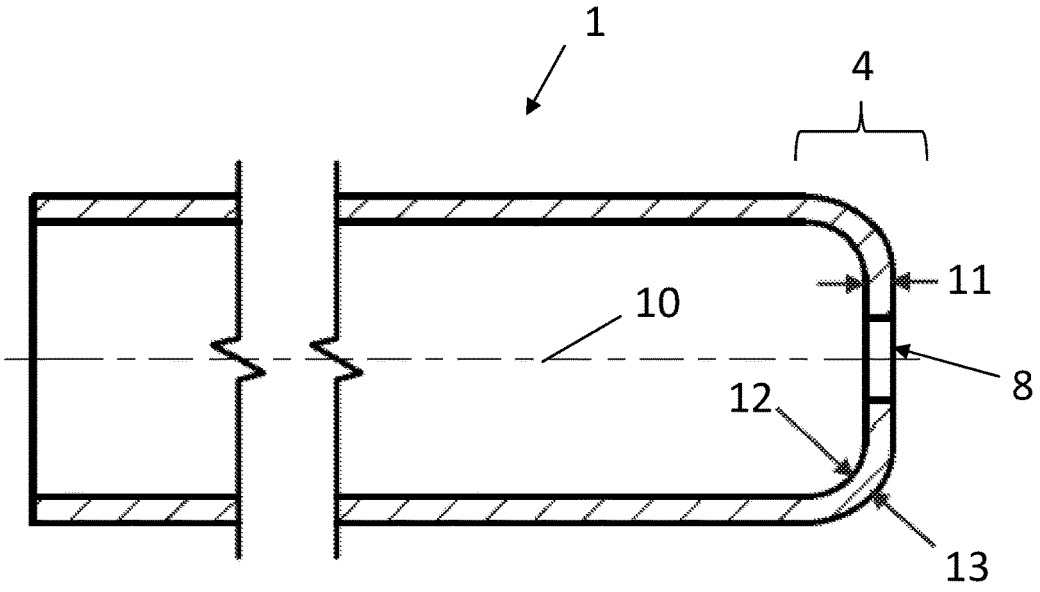
FIG. 4 shows the final produced tubular product.

This increased wall thickness is thinned out again by the calibration described. This thinning-out of the wall thickness in the end region facilitates the rolling (described below) of the end region and makes this reproducible. Such a calibrated pre-geometry 3 is shown in FIG. 3.

The shaping of the steel tube 2 and pre-geometry 3 described above were all carried out by cold forming or cold drawing. In cold forming or cold drawing, the shaping takes place between room temperature and a temperature lower than 473 K, in particular without preheating and without heated tools. Simple lubricant may be used between the individual parts during shaping so that the steel tube 20 and pre-geometry 3 can slide on one another and on the inserted tools and mandrels more easily.

In order now to shape the pre-geometry into the definitive tubular product 1, the pre-geometry is axially displaced into a drawing tool (not shown in the drawings) with a roll-in contour having a U-shaped cavity, with simultaneous shaping of the pre-geometry into the tubular product with a rotationally symmetrical outlet opening positioned centrally in an end face.

In the context of the present invention, U-shaped or pot-like means an at least partially curved course of a wall between the outlet opening and the unshaped tube portions, e.g., also hemispherical.

This shaping takes place as hot forming or semi-hot forming between a temperature of 473 K up to an Ac1 temperature of the steel used, which lies at 1173 K for the steels and steel alloys used for the tubular product.

The end region 4 and outlet opening 8 of the tubular product 1 are shaped by insertion of a second inner mandrel (also not shown here), which has an outer contour corresponding to the inner contour of the calibrated end region 4 of the tubular product 1, and an axial movement of the second inner mandrel and tubular product into a second outer tool (also not shown here), the inner contour of which corresponds to the outer contour of the calibrated end region 4 of the tubular product 1.

In this final step of shaping by hot forming, during rolling of the end region 4 and subsequent insertion of the second inner mandrel, a transverse wall thickness 11 on the end face is again slightly reduced, wherein the geometry of the outlet opening 8 is at the same time optimized. The inner radii 12 and outer radii 13 are simultaneously reduced in the rolling region of the end region 4.

In the exemplary embodiments shown here, the end region 4 of the steel tube 2 is drawn over the length which is necessary for rolling of the pre-geometry 3 and for forming the outlet opening 8. In a further exemplary embodiment (not shown here), the drawing may take place over a larger end region of the starting steel tube 2. The later rolling does not, however, concern the entire drawn end region, so that the inner and outer radius of the final tubular product in the unrolled end region is reduced accordingly in comparison with the longitudinal extent of the tubular product lying outside the end region 4.

The present invention is not limited to embodiments described herein; reference should be had to the appended claims.

LIST OF REFERENCE SIGNS

1 Tubular product
2 Steel tube
3 Pre-geometry
4 End region
5 Outer diameter
6 Outer diameter
7 Inner diameter
8 Outlet opening
9 Rotational axis
10 Thickness
11 Inner radius
12 Outer radius

What is claimed is:

1. A method for production of an airbag tube, the method comprising:

a step a) of providing a steel tube having an axial length, an outer diameter which is perpendicular to the axial length, and an inner diameter which is parallel to the outer diameter, wherein the axial length is greater than each of the outer diameter and the inner diameter;

a step b) of shaping the steel tube into a pre-geometry, the shaping being performed by axially moving the steel tube into an outer tool so as to thereby provide the pre-geometry with the outer diameter which is reduced in an end region in the outer tool, wherein the shaping in step b) is performed via a cold forming together with a lubricant or via a cold drawing together with a lubricant;

a step c) of calibrating an inner diameter of the pre-geometry, the calibrating being performed while the pre-geometry is arranged within the outer tool by, introducing an inner mandrel having an outer diameter which corresponds to the inner diameter of the pre-geometry into the end region of the pre-geometry, and pressing the pre-geometry against the outer tool so that the inner diameter of the pre-geometry is calibrated via a shaping in the end region, wherein the shaping in step c) is performed via a cold forming together with a lubricant or via a cold drawing together with a lubricant, without a preheating and without heated tools;

a step d) of removing the pre-geometry from the outer tool and removing the inner mandrel from the pre-geometry;

a step e) of axially moving the pre-geometry into a drawing tool comprising a roll-in contour which comprises a concave shape, thereby simultaneously shaping the pre-geometry into the airbag tube comprising a rotationally symmetrical outlet opening which is positioned centrally in an end face, wherein the shaping in step e) is performed via a hot forming together with a temperature-resistant lubricant or via a semi-hot forming together with a temperature-resistant lubricant; and a step f) of removing the airbag tube from the drawing tool, wherein, in each of the step b) and the step d), no rotation of the pre-geometry with respect to the outer tool is performed, and the airbag tube has a tensile strength of at least 700 MPa.

2. The method as recited in claim 1, wherein the shaping in the step b) takes place as a cold forming or as a cold drawing.

3. The method as recited in claim 1, wherein the shaping in the step c) takes place as a cold forming.

4. The method as recited in claim 1, wherein the shaping in the step e) takes place as a hot forming or as a semi-hot forming.

5. The method as claimed in claim 1, further comprising:

providing a calibration or a finish-forming of at least one of the end region and of outlet opening of the pre-geometry by, inserting a second inner mandrel which has an outer contour which corresponds to an inner contour of the end region of the airbag tube to be produced into the outlet opening of the pre-geometry, and axially moving the second inner mandrel and the pre-geometry into a second outer tool which has an inner contour which corresponds to an outer contour of the end region of the airbag tube to be produced.

6. The method as recited in claim 5, wherein, for the calibration or the finish-forming of the outlet opening, the second inner mandrel comprises a rotationally symmetrical element which is positioned centrally in an end face of the second inner mandrel, the outer contour of the rotationally symmetrical element corresponding to the inner contour of the outlet opening of the airbag tube to be produced.

7. The method as claimed in claim 6, wherein the calibration of the at least one of the end region and of the outlet opening is performed in a residual heat of a hot forming or of a semi-hot forming which is generated when performing the step e).

8. The method as recited in claim 7, wherein the residual heat of the hot forming or of the semi-hot forming which is performed in the step e) has a temperature of at least 473 K or a temperature lower than an Ac1 temperature of a steel or a steel alloy of the airbag tube.

9. The method as recited in claim 6, further comprising:

prior to the step e), heating the pre-geometry to >an Ac3 temperature; and after the step e) or after the outlet opening is calibrated, actively cooling the pre-geometry so as to form an at least partially hardened grain structure in a steel alloy.

10. The method as recited in claim 1, wherein the steel tube comprises as a steel a steel alloy.

11. The method as recited in claim 1, wherein the steel tube comprises a steel which comprises iron and unavoidable melt-induced contaminants comprising:

0.07 to 0.50 wt-% of C, 0.05 to 0.55 wt-% of Si,
0.2 to 2.5 wt-% of Mn,
<0.025 wt-% of P,
<0.02 wt-% of S,
<2 wt-% of Cr,
<0.03 wt-% of Ti,
<0.6 wt-% of Mo,
<0.6 wt-% of Ni,
0.001 to 0.05 wt-% of Al,
<0.5 wt-% of V, and
<0.1 wt-% of Nb.

12. The method as recited in claim 1, wherein the steel tube comprises a steel which comprises iron and unavoidable melt-induced contaminants comprising:

0.07 to 0.20 wt-% of C,
0.05 to 0.55 wt-% of Si,
0.4 to 0.8 wt-% of Mn,
<0.025 wt-% of P,
<0.02 wt-% of S,
0.8 to 1.0 wt-% of Cr,
<0.015 wt-% of Ti,
0.25 to 0.4 wt-% of Mo,
0.2 to 0.3 wt-% of Ni,
0.02 to 0.04 wt-% of Al,
<0.1 wt. % of V, and
<0.06 wt-% of Nb.

13. The method as recited in claim 1, wherein the steel alloy is a steel which has a tensile strength of at least 700 MPa.

14. A method for production of an airbag tube, the method comprising:

a step a) of providing a steel tube having an axial length, an outer diameter which is perpendicular to the axial length, and an inner diameter which is parallel to the outer diameter, wherein the axial length is greater than each of the outer diameter and the inner diameter;

a step b) of shaping an end region the steel tube into a pre-geometry, the shaping being performed by axially moving the steel tube into an outer tool so as to thereby provide the pre-geometry with the outer diameter which is reduced in the end region in the outer tool and so that an end part of a length of the end region is parallel to a rest of the steel tube which was not shaped, wherein the shaping in step b) is performed via a cold forming together with a lubricant or via a cold drawing together with a lubricant;

a step c) of calibrating an inner diameter of the pre-geometry, the calibrating being performed while the pre-geometry is arranged within the outer tool by, introducing an inner mandrel having an outer diameter which corresponds to the inner diameter of the pre-geometry into the end region of the pre-geometry, and pressing the pre-geometry against the outer tool so that the inner diameter of the pre-geometry is calibrated via a shaping in the end region, wherein the shaping in step c) is performed via a cold forming together with a lubricant or via a cold drawing together with a lubricant, without a preheating and without heated tools;

a step d) of removing the pre-geometry from the outer tool and removing the inner mandrel from the pre-geometry;

a step e) of axially moving the pre-geometry into a drawing tool comprising a roll-in contour which comprises a concave shape, thereby simultaneously shaping the pre-geometry into the airbag tube comprising a rotationally symmetrical outlet opening which is positioned centrally in an end face, wherein the shaping in step e) is performed via a hot forming together with a temperature-resistant lubricant or via a semi-hot forming together with a temperature-resistant lubricant; and a step f) of removing the airbag tube from the drawing tool, wherein, in each of the step b) and the step d), no rotation of the pre-geometry with respect to the outer tool is performed, and the airbag tube has a tensile strength of at least 700 MPa.

15. A method for production of an airbag tube, the method comprising:

a step a) of providing a steel tube having a tensile strength of at least 700 MPa, axial length, an outer diameter which is perpendicular to the axial length, and an inner diameter which is parallel to the outer diameter, wherein the axial length is greater than each of the outer diameter and the inner diameter;

a step b) of shaping the steel tube into a pre-geometry, the shaping being performed by axially moving the steel tube into an outer tool so as to thereby provide the pre-geometry with the outer diameter which is reduced in an end region in the outer tool, wherein the shaping in step b) is performed via a cold forming together with a lubricant or via a cold drawing together with a lubricant;

a step c) of calibrating an inner diameter of the pre-geometry, the calibrating being performed while the pre-geometry is arranged within the outer tool by, introducing an inner mandrel having an outer diameter which corresponds to the inner diameter of the pre-geometry into the end region of the pre-geometry, and pressing the pre-geometry against the outer tool so that the inner diameter of the pre-geometry is calibrated via a shaping in the end region, wherein the shaping in step c) is performed via a cold forming together with a lubricant or via a cold drawing together with a lubricant, without a preheating and without heated tools;

a step d) of removing the pre-geometry from the outer tool and removing the inner mandrel from the pre-geometry;

a step e) of axially moving the pre-geometry into a drawing tool comprising a roll-in contour which comprises a concave shape, thereby simultaneously shaping the pre-geometry into the airbag tube comprising a rotationally symmetrical outlet opening which is positioned centrally in an end face, wherein the shaping in step e) is performed via a hot forming together with a temperature-resistant lubricant or as a semi-hot forming together with a temperature-resistant lubricant; and a step f) of removing the airbag tube from the drawing tool, wherein, in each of the step b) and the step d), no rotation of the pre-geometry with respect to the outer tool is performed, and the airbag tube has a tensile strength of at least 700 MPa.

* * * * *